United States Patent [19]

Winstanley

[11] Patent Number: 5,012,617

[45] Date of Patent: May 7, 1991

[54] DUAL PURPOSE GRINDING MACHINE

[76] Inventor: Ralph Winstanley, Wetmoor Lane, Wath-upon-Dearne, Rotherham S63 7LR, England

[21] Appl. No.: 584,390

[22] Filed: Sep. 18, 1990

Related U.S. Application Data

[63] Continuation of Ser. No. 302,109, Jan. 25, 1989, abandoned, which is a continuation of Ser. No. 61,420, Jun. 12, 1987, abandoned, which is a continuation of Ser. No. 862,264, May 12, 1986, abandoned.

[30] Foreign Application Priority Data

May 21, 1985 [GB] United Kingdom ..... 8512770

[51] Int. Cl.[5] ..... B24B 3/42; B24B 3/55

[52] U.S. Cl. ..... 51/3; 51/48 HE; 51/271

[58] Field of Search ..... 51/3, 48 HE, 271, 269, 51/268

[56] References Cited

U.S. PATENT DOCUMENTS

| | | | |
|---|---|---|---|
| 2,153,502 | 4/1939 | Ocenasek | 51/3 |
| 2,279,798 | 4/1942 | Shelburne | 51/48 HE |
| 2,879,629 | 3/1959 | Machovec | 51/48 HE |
| 3,045,398 | 7/1962 | McEwan | 51/48 HE |
| 3,061,980 | 11/1962 | Machovec | 51/48 HE |
| 3,964,212 | 6/1976 | Karden | 51/170 PT |

*Primary Examiner*—Robert A. Rose
*Attorney, Agent, or Firm*—William R. Hinds

[57] ABSTRACT

A dual purpose grinding machine for use in grinding the blades of the blade cylinder, or the bottom blade, of a cylinder type mowing machine, selectively. The machine has a grinding wheel head with a cylindrical grinding wheel and a cupped grinding wheel, the two grinding wheels being usable selectively. The grinding wheel head is traversable on guides, and means for mounting a blade cylinder for rotation and means for mounting a bottom blade on the machine for grinding are arranged in parallel relation to the guides.

7 Claims, 5 Drawing Sheets

DUAL PURPOSE GRINDING MACHINE

This is a continuation of application Ser. No. 302,109 filed Jan. 25, 1989, abandoned, which is a continuation of Ser. No. 061,420 filed June 12, 1987, now abandoned, which is a continuation of Ser. No. 862,264 filed May 12, 1986, now abandoned.

FIELD OF THE INVENTION

The invention relates to a dual purpose grinding machine for use in the maintenance of cylinder type mowing machines.

Cylinder type mowing machines are very well known and include a blade cylinder having cutting blades extending helically between a plurality of spaced discs. The blade cylinder is rotatable about a horizontal axis and co-operates with a so-called bottom blade which extends across the underside of the machine and engages each of the cutting blades in turn as the cutting cylinder rotates.

Grinding machines are known for sharpening the blades of the blade cylinder, such a machine comprising means for mounting the blade cylinder for rotation about the axis of its mounting shaft either for spin grinding or for the grinding of a constant amount of back relief along the length of each blade in turn, these grinding functions generally being carried out using a relatively narrow cylindrical grinding wheel. When it is necessary to grind the bottom blade, this can best be done using a cupped grinding wheel.

The object of the invention is to provide a grinding machine by means of which both the blade cylinder and the bottom blade can be ground.

SUMMARY OF THE INVENTION

According to the invention, there is provided a dual purpose grinding machine for grinding mowing machine cylinder blades and botton blades, selectively, the machine including a common basal surface and respective separate mounting assemblies for locating on the common basal surface for respectively separately mounting a blade cylinder for rotation about its longitudinal axis and for separately mounting a bottom blade in parallel relation to the mounting assembly for the blade cylinder, the mounting assembly for mounting a bottom blade in position for grinding including a pair of spaced brackets for clamping in position on the basal surface and carrying between them a mounting frame for a bottom blade, the mounting frame being provided with means for securing a bottom blade in position thereon and being adjustably clamped to the spaced brackets about a longitudinal axis for varying the angle of the surface of the bottom blade to be ground, a grinding wheel head mounted on guides for transverse movement longitudinally of the blade cylinder and of the bottom blade, whichever is mounted at the time, a mounting for a cylindrical grinding wheel on the grinding wheel head, a mounting for a cupped grinding wheel on the grinding wheel head, the cupped grinding wheel having an axially facing annular grinding surface for grinding the bottom blade, and means for bringing the two grinding wheels to respective operating grinding positions, selectively, for use, by movement of the grinding wheel head about a vertical axis. The grinding wheel head may have a single electric motor for driving the two grinding wheels, and the two grinding wheels will preferably be mounted on the opposite ends of the motor shaft. In this case, the grinding wheel head will preferably include an upstanding pillar on which the motor and the two grinding wheels are mounted, the upstanding pillar being capable of being adjusted in position through a right angle to bring the two grinding wheels to their operative positions, selectively.

The machine will preferably include means for traversing the grinding wheel head to and fro on its guides, and a finger guide adjustably positioned beneath the cylindrical grinding wheel for grinding a blade cylinder, the finger guide constituting a support for each blade of the blade cylinder in turn as grinding takes place so that as a traverse movement of the grinding head takes place the abutment of the finger guide against the particular blade concerned and the abrasive action of the grinding wheel against the blade causes the blade cylinder to rotate in timed relation to the traverse movement of the grinding wheel head and in the appropriate direction according to the direction of traverse of the grinding wheel head.

The cupped grinding wheel may be shrouded by an open ended casing which is arranged to project beyond the working surface of the grinding wheel when the grinding wheel is not in use, the casing being held in that position by a spring whereby it can be displaced, against the force of the spring, by contact against a bottom blade which is to be ground, to enable the grinding wheel to engage the bottom blade. Alternatively, each grinding wheel may be provided with a removable cover, and each cover, in being secured in position to shroud the appropriate grinding wheel, will preferably be caused to close the contacts of a respective microswitch, the arrangement being such that when either one of the two grinding wheels has been brought to its operative position for use, the motor is inoperative until the removable cover for the other grinding wheel has been replaced. The mounting assembly for mounting a blade cylinder in position for grinding may include a pair of upstanding mounting brackets capable of being clamped in position on the basal surface and between which a blade cylinder can be mounted for rotation, drive from power driven main chucks being transmitted to the blade cylinder by means of respective universally jointed shafts.

DESCRIPTION OF THE PREFERRED EMBODIMENT

Figure 1:
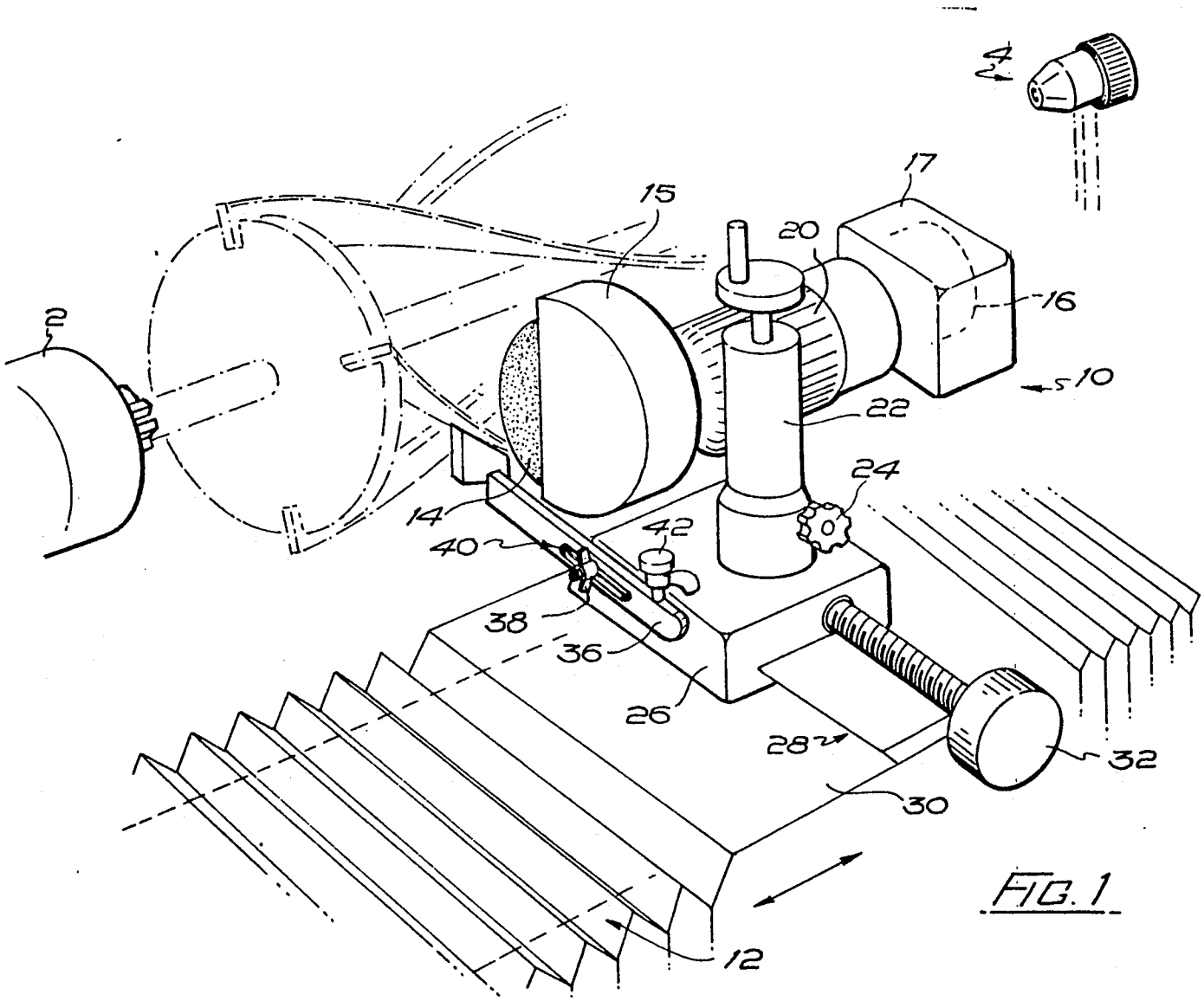
FIG. 1 is a perspective view of a dual purpose grinding machine embodying the invention, arranged for the grinding of a mowing machine blade cylinder.

Referring now to the drawings, the dual purpose grinding machine there illustrated is capable of grinding both the blade cylinder and the bottom blade of a cylinder type mowing machine. The grinding machine includes means for mounting a blade cylinder (shown in chain-dotted lines in FIG. 1) for rotation about the axis of its mounting shaft, and also includes means for mounting a bottom blade (shown in chain-dotted lines in FIG. 2) in parallel relation to the mounting means for the blade cylinder, the arrangement being such that either a blade cylinder, or a bottom blade can be mounted on the machine for sharpening, alternatively. The means for mounting a blade cylinder for rotation about the axis of its mounting shaft are in this embodiment shown to be constituted by a drive chuck 2 at a headstock end of the machine and mounting means 4 at a tailstock end of the machine. The means for mounting a bottom blade in parallel relation to the mounting means for a blade cylinder include a pair of widely spaced clamps 6.

Figure 2:
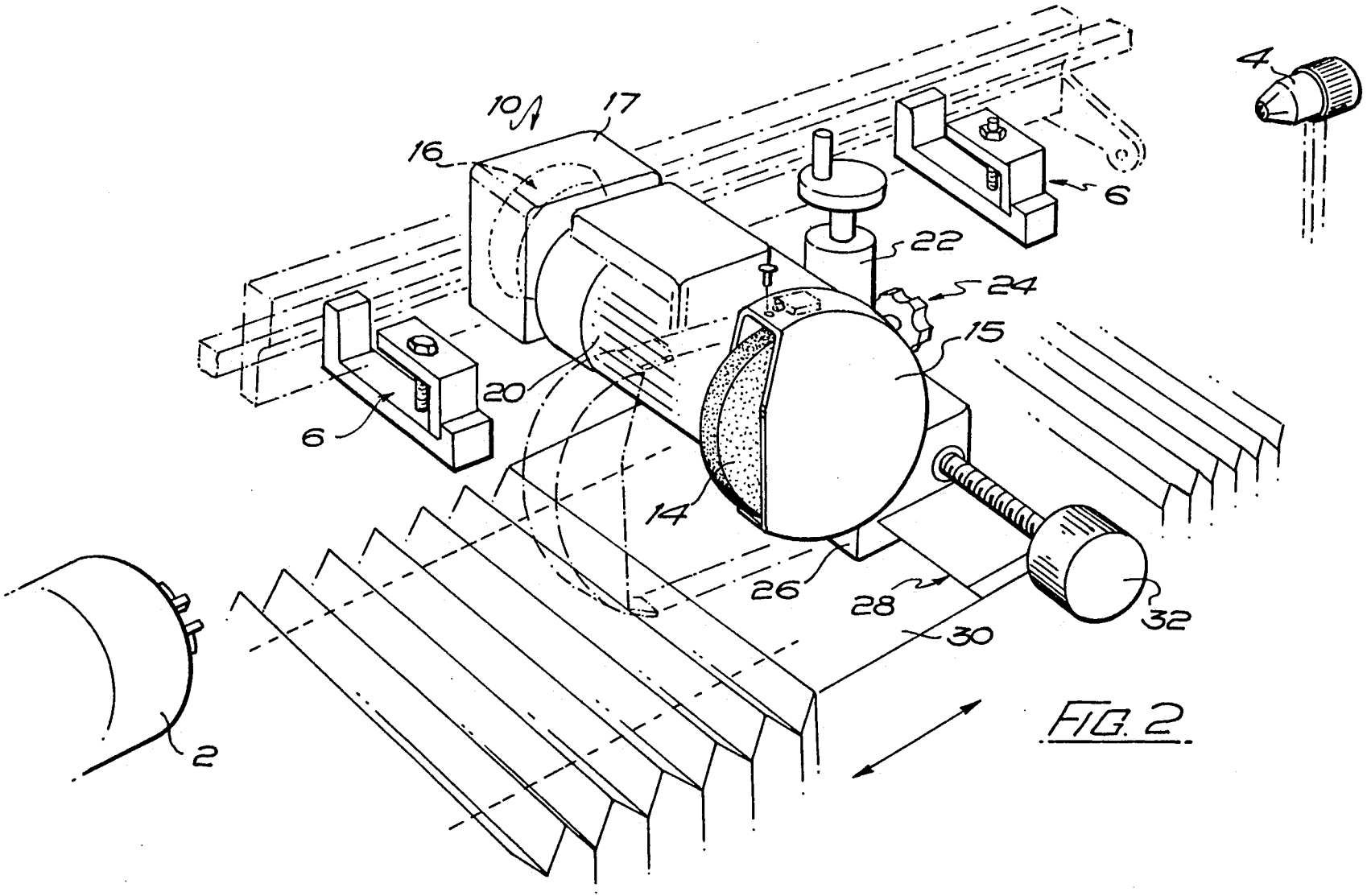
FIG. 2 is a view similar to FIG. 1 but showing the machine arranged for the grinding of a bottom blade.
Figure 3:
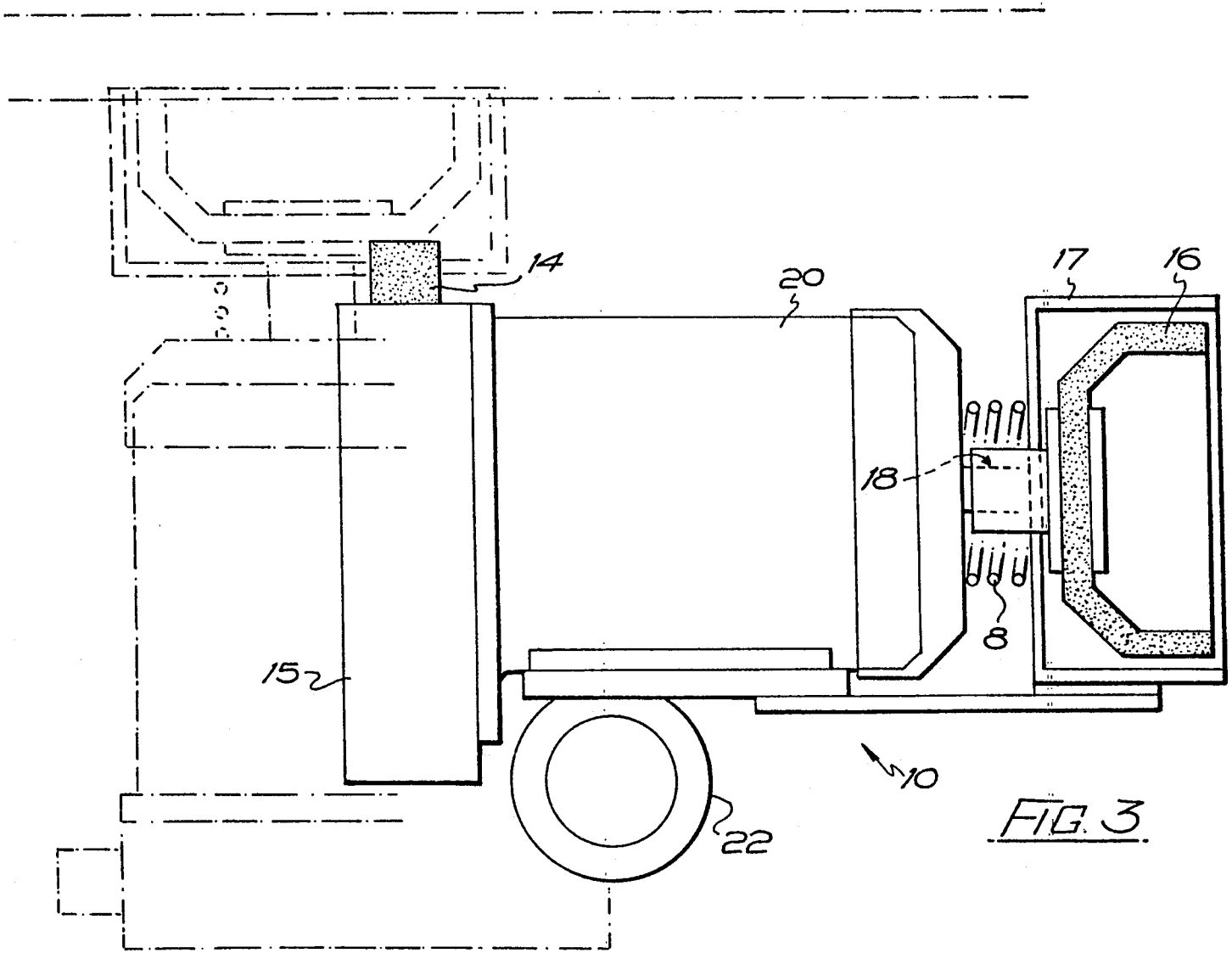
FIG. 3 is a diagrammatic plan view of a part of the machine.

A grinding wheel head, generally indicated 10, is mounted on guides 12 for traverse movement longitudinally of the blade cylinder or of the bottom blade, as the case may be. The grinding wheel head has a cylindrical grinding wheel 14 for the grinding of blade cylinders and a cupped grinding wheel 16 for the grinding of bottom blades, the two wheels being mounted on opposite ends of the driving shaft 18 of an electric motor 20. The cylindrical grinding wheel 14 is surrounded by a closely fitting casing 15. The cupped grinding wheel 16 is shrouded by an open ended casing 17. As shown in FIG. 3, in this particular embodiment the casing 17 is arranged to project slightly beyond the working surface of the cupped grinding wheel when the latter is not in use. When the grinding wheel is brought into use, however, the casing is able to be displaced, aginst the force of a spring 8, by contact against a bottom blade which is to be ground, to enable the grinding wheel to engage the bottom blade. An upstanding pillar 22 on which the motor and the two grinding wheels are mounted is arranged to move through a right angle about its vertical axis to bring the grinding wheels to their operative positions selectively. In FIG. 1, the cylindrical grinding wheel 14 is shown in its operative position for grinding a blade cylinder. In FIG. 2, the cupped grinding wheel 16 is shown in its operative position for grinding a bottom blade. A manually operable locking wheel 24 is provided for locking the upstanding pillar in its selected position.

The upstanding pillar 22 on which the motor and the two grinding wheels are mounted is carried by a cross slide 26 which is slidably adjustable on dovetailed guides 28 on a saddle part 30 of the machine. The cross slide can be adjusted, by means of a manually operable adjustment wheel 32, to adjust the cylindrical grinding wheel towards or away from the axis of a blade cylinder or to adjust the cupped grinding wheel towards or away from a bottom blade.

When set up for grinding a blade cylinder, the machine can either be used for spin grinding or for the grinding of a constant amount of back relief along the length of each blade in turn. In this latter case, a finger guide 34 is adjustably positioned as shown in FIG. 1 beneath the grinding wheel as a support for each blade of the blade cylinder in turn as grinding takes place. The finger guide is carried by an arm 36 which is clamped in position against the side of the grinding wheel head by means of a wing nut 38. The stud which the wing nut engages extends through a slot 40 in the arm so that the latter is adjustable towards or away from a blade cylinder mounted in the machine. The end of the arm remote from the finger guide is acted on by an adjusting screw 42 by means of which the vertical height of the finger guide can be adjusted. As a traverse movement of the grinding wheel head takes place, the abutment of the finger guide against the particular blade concerned and the abrasive action of the grinding wheel against the blade causes the blade cylinder to rotate in timed relation to the traverse movement of the grinding wheel head and in the appropriate direction according to the direction of traverse of the grinding wheel head.

Figure 4:
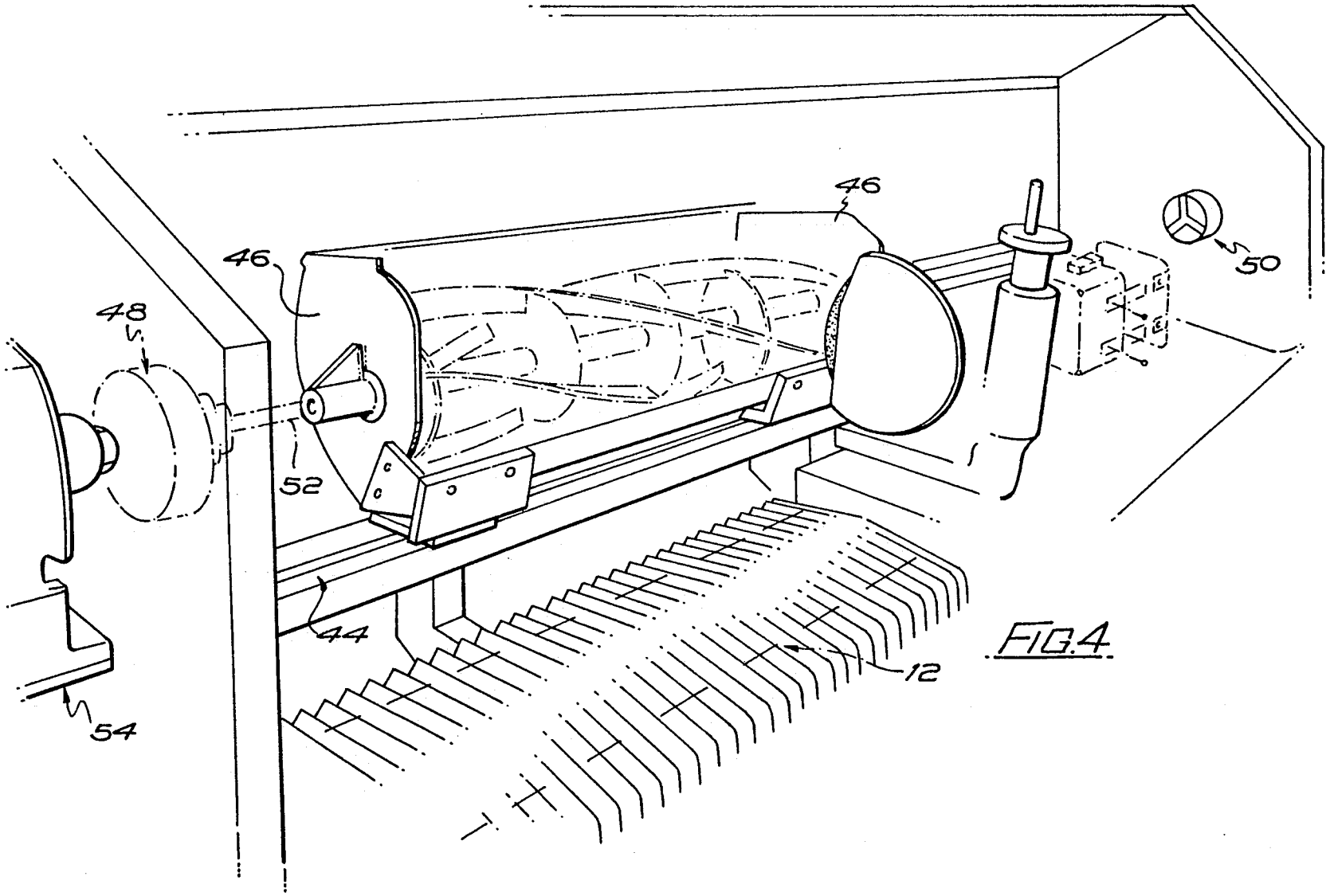
FIGS. 4 and 5 are perspective views of the machine which show rather more of the details of construction of the machine.
Figure 5:
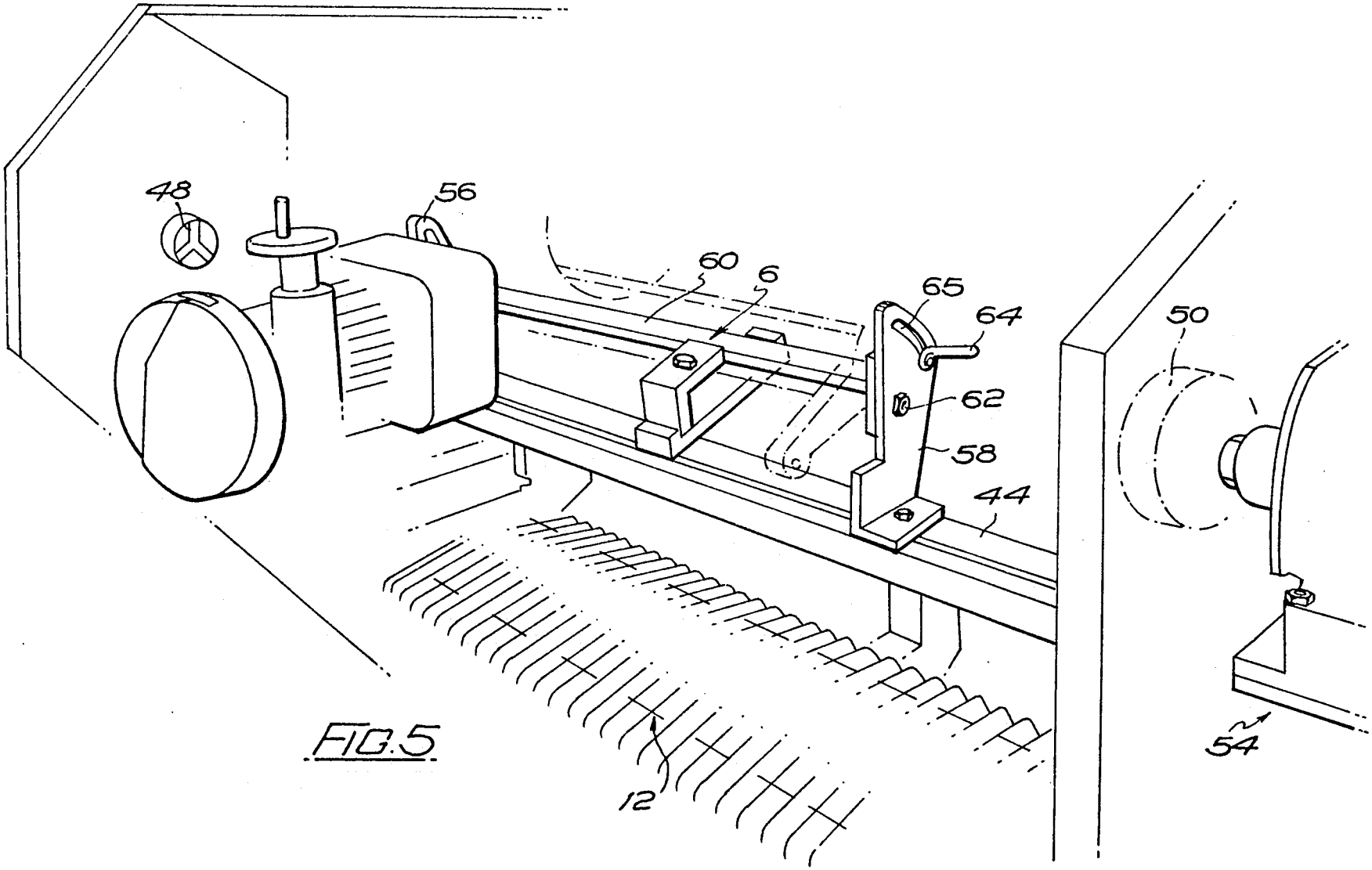

Referring now to FIGS. 4 and 5 these illustrate rather more of the details of construction of the machine rather than what may be termed its essential functions. Thus, it will be seen that the means for mounting a blade cylinder for rotation about its longitudinal axis and the means for mounting a bottom blade in parallel relation to the mounting means for the blade cylinder include respective assemblies capable of being located on a common basal surface 44 extending in parallel with the guides 12 on which the grinding wheel head is mounted.

In FIG. 4 there is illustrated the mounting assembly for mounting a blade cylinder in position for grinding, the assembly including a pair of upstanding mounting brackets 46 between which a blade cylinder can be mounted for rotation, drive from the appropriate one of power driven chucks 48 and 50 being transmitted to the blade cylinder by means of a universally jointed shaft 52 which can be connected to the blade cylinder at either end of the mounting assembly. Because blade cylinders are required to be capable of being driven from either end according to the design of the mowing machine for which they are intended, the machine is provided with the separate drive chucks 48 and 50 at its opposite ends, these being located inside respective end walls of the machine, as shown, respective geared motor drive units 54 being located externally of the end walls and usable selectively.

In FIG. 5 there is illustrated the mounting assembly for mounting a bottom blade in position for grinding, the assembly including a pair of spaced brackets 56, 58 capable of being clamped in position on the basal surface 44 as shown, the brackets carrying between them a mounting frame generally indicated 60 for securing a bottom blade in position for grinding. The mounting frame, which is provided with the spaced pair of clamps 6, 6 for locating a bottom blade in position as shown, is adjustable about a longitudinal axis, that is to say about the axes of respective bolts 62, so that the angle of the ground surface of the bottom blade can be varied. Respective clamps 64 adjustable along arcuate slots 65 are provided for securing the mounting frame in its adjusted position.

Thus there is provided a grinding machine which is a dual purpose machine by virtue of the fact that not only can it be used for the grinding of the blades of a blade cylinder of a cylinder type mowing machine but which can also be used for the grinding of the bottom blade. However, various modifications may be made. For example, it is not essential for the two grinding wheels to be mounted on the opposite ends of the motor shaft. It would be quite possible for the two grinding wheels to be mounted side by side on one end of the motor shaft (the cupped wheel being outermost of course). The machine may be provided with means for automatically indexing the blade cylinder around from one blade to the next when a blade cylinder is being ground to form a constant amount of back relief along the length of each blade in turn.

Instead of the shroud for the cupped wheel being provided with a spring loaded casing as shown in FIG. 3, it may be preferred to provide each grinding wheel with a removable cover secured in position by screws when the appropriate grinding wheel is not in use. In this case it will preferably be arranged that each cover, in being secured in position to completely enclose the grinding wheel concerned, closes the contacts of a respective micro-switch, shown in chain-dotted lines on the respective covers in FIGS. 2 and 4 (or operates some other control to render an appropriate system inoperative), the arrangement being such that when either one of the two grinding wheels has been brought to its operative position for use, the motor 20 is inoperative until the removable cover for the other grinding wheel has been replaced.

What I claim and desire to secure by Letters Patent is:

1. A dual purpose grinding machine for grinding mowing machine cylinder blades and bottom blades, selectively, the machine including a common basal surface and respective separate mounting assemblies for locating on the common basal surface for respectively separately mounting a blade cylinder for rotation about its longitudinal axis and for separately mounting a bottom blade in parallel relation to the mounting assembly for the blade cylinder, the mounting assembly for mounting a bottom blade in position for grinding including a pair of spaced brackets for clamping in position on the basal surface and carrying between them a mounting frame for a bottom blade, the mounting frame being provided with means for securing a bottom blade in position thereon and being adjustably clamped to the spaced brackets about a longitudinal axis for varying the angle of the surface of the bottom blade to be ground; a grinding wheel head mounted on guides for transverse movement longitudinally of the blade cylinder and of the bottom blade, whichever is mounted at the time; a mounting for a cylindrical grinding wheel on the grinding wheel head; a mounting for a cupped grinding wheel on the grinding wheel head, the cupped grinding wheel having an axially facing annular grinding surface for grinding the bottom blade; and means for bringing the two grinding wheels to respective operative grinding positions, selectively, for use, by movement of the grinding wheel head about a vertical axis.

2. A dual purpose grinding machine according to claim 1, in which the grinding wheel head has a single electric motor for driving the two grinding wheels, the two grinding wheels being mounted on opposite ends of a motor shaft projecting from opposite ends of the motor, the grinding wheel head including an upstanding pillar on which the motor, carrying the grinding wheels, is mounted, the upstanding pillar being capable of being adjusted in position through a right angle to bring the two grinding wheels to respective operative grinding positions, selectively, for use.

3. A dual purpose grinding machine according to claim 1, including means for traversing the grinding wheel head to and fro on its guides, and a finger guide adjustably positioned beneath the cylindrical grinding wheel for guiding a blade cylinder, the finger guide constituting a support for each blade of the blade cylinder in turn as grinding takes place so that as a traverse movement of the grinding wheel head takes place the abutment of the finger guide against the particular blade of the blade cylinder concerned and the abrasive action of the cylindrical grinding wheel against the blade causes the blade cylinder to rotate in timed relation to the traverse movement of the grinding wheel head in the appropriate direction according to the direction of traverse of the grinding wheel head.

4. A dual purpose grinding machine according to claim 1, in which the cupped grinding wheel is shrouded by an open ended casing which is arranged to project beyond the working surface of the cupped grinding wheel when the cupped grinding wheel is not in use, the casing being held in that position by a spring whereby it can be displaced, against the force of the spring, by contact against a bottom blade which is to be ground, to enable the grinding wheel to engage the bottom blade.

5. A dual purpose grinding machine according to claim 1, in which each grinding wheel is provided with a removable cover, and each cover, in being secured in position to shroud the appropriate grinding wheel, closes contacts of a respective micro-switch, the arrangement being such that when either one of the two grinding wheels has been brought to its operative grinding position for use, the motor is inoperative until the removable cover for the other grinding wheel has been replaced.

6. A dual purpose grinding machine according to claim 1, in which the mounting assembly for mounting a blade cylinder includes a pair of upstanding mounting brackets for clamping in position on the basal surface and between which a blade cylinder can be mounted for rotation.

7. A dual purpose grinding machine according to claim 6, further including power driven main chucks for transmitting drive to the blade cylinder by means of respective universally jointed shafts.

* * * * *